US008843299B2

(12) United States Patent
Kawazu et al.

(10) Patent No.: US 8,843,299 B2
(45) Date of Patent: Sep. 23, 2014

(54) CONTROL APPARATUS FOR CONTROLLING ON-VEHICLE STARTER FOR STARTING ENGINE

(75) Inventors: Shinsuke Kawazu, Kariya (JP); Nobuhiko Shima, Kariya (JP); Hideya Notani, Kariya (JP)

(73) Assignee: Denso Corporation, Kariya (JP)

( * ) Notice: Subject to any disclaimer, the term of this patent is extended or adjusted under 35 U.S.C. 154(b) by 891 days.

(21) Appl. No.: 13/027,615

(22) Filed: Feb. 15, 2011

(65) Prior Publication Data

US 2011/0202263 A1 Aug. 18, 2011

(30) Foreign Application Priority Data

Feb. 15, 2010 (JP) ..... 2010-030400

(51) Int. Cl.
*F02N 11/08* (2006.01)
*F02N 11/00* (2006.01)

(52) U.S. Cl.
CPC ..... *F02N 11/0848* (2013.01); *F02N 2200/044* (2013.01); *F02N 2200/042* (2013.01); *F02N 2200/048* (2013.01); *F02N 2200/043* (2013.01)
USPC ..... 701/113; 123/179.3

(58) Field of Classification Search
USPC ..... 701/113, 114, 102; 123/179.3, 179.25, 123/179.1
See application file for complete search history.

(56) References Cited

U.S. PATENT DOCUMENTS

| | | | | |
|---|---|---|---|---|
| 1,414,653 | A * | 5/1922 | Kratz | 290/38 A |
| 4,305,002 | A * | 12/1981 | Mortensen | 290/38 R |
| 6,651,603 | B2 * | 11/2003 | Osada et al. | 123/179.3 |
| 2010/0050971 | A1 * | 3/2010 | Park et al. | 123/179.25 |

FOREIGN PATENT DOCUMENTS

| | | |
|---|---|---|
| JP | 4083268 | 4/2008 |
| JP | 4211208 | 11/2008 |
| JP | 4214401 | 11/2008 |

* cited by examiner

*Primary Examiner* — Mahmoud Gimie
(74) *Attorney, Agent, or Firm* — Nixon & Vanderhye PC

(57) ABSTRACT

A control apparatus for controlling a starter used to start an engine mounted on a vehicle, the starter generating a torque and having a first gear mechanically engaged with a second gear of the engine to start the engine. The control apparatus includes a trigger circuit adapted to output a trigger signal in response to a start request; a detection circuit adapted to detect an electrical state and a mechanical state of the starter while the starter is powered on; and a controller adapted to control power on and off of the starter. The controller powers on the starter in response to the trigger signal outputted by the trigger circuit, and powers off the starter when the controller detects that a predetermined condition is satisfied based on the state of the starter.

8 Claims, 11 Drawing Sheets

CONTROL APPARATUS FOR CONTROLLING ON-VEHICLE STARTER FOR STARTING ENGINE

CROSS-REFERENCE TO RELATED APPLICATION

This application is related to Japanese Patent Application No. 2010-30400 filed on Feb. 15, 2010, the contents of which are hereby incorporated by reference.

TECHNICAL BACKGROUND

1. Technical Field

The present invention relates to a control apparatus for starting an engine mounted on a vehicle, and more particularly to a control apparatus having power-off control function adapted to starters for starting engines.

2. Description of the Related Art

Generally, starters for starting engines are powered off when the starter completes starting of the engine. A control apparatus is used to control powering off of the starter when a predetermined power-off condition is detected. The power-off condition varies depending on types of starter operations. Conventionally, the starter operations include the following three types.

(a) One of three types of starter operations implements a rotary-type switch (ignition key switch) for starting the engine: the driver triggers the starter operation such that the driver turns the ignition key switch from the ON position to the START position whereby the starter is powered to crank the engine, and therefore the engine starts. The driver turns the ignition key from the START position to the ON position to stop the starter operation (powering off the starter) when the driver determines the engine is started.

(b) One of three types of starter operations implements a press-type start switch (ignition switch) for starting the engine: the driver triggers the starter operation such that the driver presses the start switch for powering the starter to start cranking the engine, thereby starting the engine. The starter operation is controlled to be stopped (powering off the starter) when a complete engine-start is detected depending on whether or not the engine rotational rate exceeds a predetermined threshold value.

(c) One of three types of starters implements an idle stop system (automatic engine stop/restart system): The starter is controlled to start the operation when a predetermined automatic start condition is met during an idle stop condition such that the starter is powered and starts cranking the engine thereby starting the engine. The starter operation is controlled to be stopped (powering off the starter) when a complete engine-start is detected depending on whether or not the engine rotational rate exceeds a predetermined threshold value. Specifically, a Japanese Patent No. 4214401 discloses the above-described technique used for an automatic stop/restart control apparatus.

Conventionally, in the above-described starter operations, the starter is supplied with power continuously until completion of the starter operation. Meanwhile, when the engine completely starts, the rotational rate of the engine is higher than the no-load rotational rate (i.e., rotational rate when no-load is applied) of the starter so that the pinion gear of the starter is rotatable by rotational force of the engine after rotational rate of the pinion gear exceeds the no-load rotational rate of the starter. However, the power is continuously supplied to the starter until the engine rotational rate reaches the predetermined threshold value. Therefore, while the starter is continuously powered, the battery power is consumed unnecessarily, which affects the battery to shorten its life-time of operation and also affects durability of the starter.

Specifically, since the idle stop system requires frequent engine restart operations, load on the battery significantly increases and therefore, the durability of the starter decreases. To enhance the durability of the starter, it may cause an increase of manufacturing cost thereof.

SUMMARY

An embodiment provides a control apparatus used for starting engine. Specifically, a control apparatus for starting the engine is provided in which operating period of supplying power to the starter is shortened whereby the load of the battery is reduced and the durability of the starter is enhanced.

As a first aspect of the embodiment, a control apparatus for controlling a starter used to start an engine mounted on a vehicle, the starter generating a torque for starting the engine and having a first gear (i.e., pinion gear) outputting the generated torque, the engine having a second gear (i.e., ring gear) to receive the torque, the first gear mechanically engaging with the second gear to start the engine, and the control apparatus includes: a trigger circuit adapted to output a trigger signal in response to a start request; a detection circuit adapted to detect an overall state of the starter which comprises an electrical state and a mechanical state of the starter while the starter is powered on; and a controller including first means configured to power on the starter in response to the trigger signal outputted by the trigger circuit, and second means configured to power off the starter when the controller detects that a predetermined condition of the starter is satisfied based on the state of the starter.

In the above-described control apparatus, the starter can be powered off when the predetermined condition (i.e., a condition where the starter cannot drive the engine to rotate) is detected even when the engine rotation rate does not reach the predetermined threshold value while the starter is powered on. As a result, operation period of the starter can be shortened and load of the battery used for the starter can be reduced, and also durability of the starter can be enhanced.

Specifically, the detection circuit can be configured to detect a torque at the first gear as a mechanical state of the starter, the torque at the first gear being transmitted to the second gear, and the controller detects the predetermined condition when the torque is a predetermined value or less and stops supplying power to the starter. While the engine is starting, when the rotational rate of the engine increases, an operational state where the first of the starter drives the second gear changes to an inverted state where the second gear drives the first to rotate thereby. As a result, rotation of a motor of the starter becomes idle rotation so that the torque applied to the second gear by the first gear becomes an idle torque. Accordingly, the above-described predetermined value is set to be a torque value which is the idle torque or around the idle torque so that the inverted state can be detected correctly.

Further, the detection circuit can be configured to detect a torque at the first gear as a mechanical state of the starter, the torque at the first gear being transmitted to the second gear, and the controller can be configured to detect the predetermined condition when a change rate of the torque is a predetermined value or more. When the first gear of the starter is driven by the second gear, the torque at the first gear becomes the idle torque. Hence, detecting the change rate of the torque whether or not the change rate of the torque rapidly changes, it is determined that the first gear of the starter is rotated (driven) by the second gear.

Alternatively, the detection circuit can be configured to detect a rotational rate of the first gear as a mechanical state of the starter, and the controller can be configured to detect the predetermined condition when the rotational rate of the first gear is a no-load rotational rate or more. Since the first gear is rotated by the second gear, the rotational rate of the first gear exceeds the no-load rotational rate.

Also, the detection circuit can be configured to detect a change rate of the rotational rate of the first gear as a mechanical state of the starter, and the controller can be detect the predetermined condition when the change rate of the rotational rate is a predetermined value or more. In a region where rotational rate at the first gear of the starter exceeds the no-load rotational rate, the engine rotational rate rapidly increases due to a combustion pressure whereby the rotational rate of the first gear rapidly increases as well. Therefore, by detecting the change rate of the rotational rate of the first gear, it is determined that the first gear of the starter is driven by the second gear.

Further, the detection circuit can be configured to detect a drive current or a drive power as an electrical state of the starter. The controller can be configured to detect the predetermined condition when the drive current or the drive power is a predetermined value or is less. While the engine is starting, load (torque) of the starter decreases when the rotational rate of the engine rotation rate increases so that the drive current of the starter decreases. Accordingly, it is determined that the first gear of the starter has been driven by the second gear when the drive current of the starter reaches the predetermined value or less.

Alternatively, the detection circuit can be configured to detect a drive voltage as an electrical state of the starter and the controller can be configured to detect the predetermined condition when the drive voltage is a predetermined value or more. While the engine is starting, the torque (load) of the starter decreases in response to an increase of the engine rotational rate whereby the drive voltage of the starter increases. Accordingly, it is determined whether or not the first gear has been driven by the second gear by detecting whether or not the drive voltage of the starter reaches the predetermined value or more.

The detection circuit can be configured to detect any one of a drive current or a drive voltage or a drive power as an electrical state of the starter. The controller can be configured to detect the predetermined condition when a change rate of any one of a drive current or a drive voltage or a drive power is a predetermined value or more. When the rotational rate at the first gear of the starter exceeds the no-load rotational rate, the engine rotational rate rapidly increases due to a combustion pressure so that the load (torque) of the starter rapidly changes. Therefore, by detecting whether or not the change rate of any one of the drive voltage, the drive current or the drive power of the starter changes rapidly, it is determined that the first gear has been driven by the second gear. When the rotational rate of the first gear exceeds the no-load rotational rate, the rotational rate of the engine rapidly increases due to a combustion pressure whereby the load (torque) of the starter deceases. Accordingly, it is determined whether or not the first gear has been driven by the second gear by detecting whether or not the change rate of any one of a drive current or a drive voltage or a drive power as an electrical state of the starter rapidly changes.

Also, the detection circuit can be configured to detect a drive current as an electrical state of the starter. The controller can be configured to detect the predetermined condition when the drive current is a no-load current value. When the rotational rate of the first gear reaches the no-load rotational rate, the drive current of the starter becomes the no-load current value. Accordingly, it is determined whether or not the first gear has been driven by the second gear by detecting whether or not the drive current of the starter becomes the no-load current value.

Above-described techniques can be adapted to either a vehicle provided with a rotary-type switch or a vehicle provided with a push-type switch. However, the techniques can be adapted to an automatic stop/restart system in which an engine is controlled to be stopped when an automatic stop condition is met and restarts when a predetermined start condition is met. Since the idle stop system requires frequent engine restart operation, a load of the battery significantly increases. Therefore, load of the battery and enhanced durability of the starter can be achieved by the above-described techniques.

DESCRIPTION OF THE PREFERRED EMBODIMENTS

Figure 1:
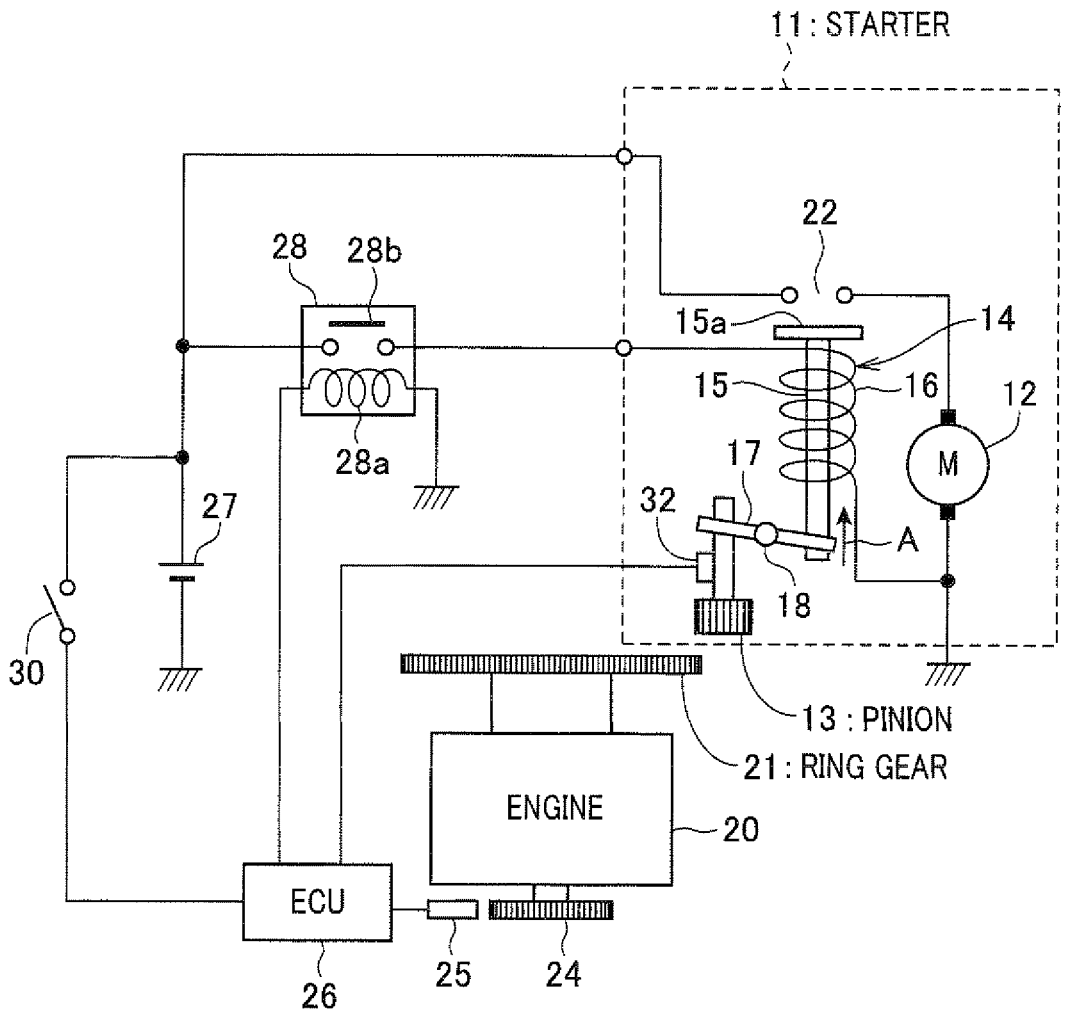
FIG. 1 is a diagram showing an overall configuration of a control system for starting an engine according to a first embodiment of the present invention.

With reference to the drawings, hereinafter will be described embodiments of the present invention.

First Embodiment

With reference to FIGS. 1 to 4, hereinafter will be described a first embodiment of the present invention. First, with reference to FIG. 1, a configuration of an automatic stop/restart system (idle stop system) is described as follows. The starter 11 is what is called pinion push out type starter including a motor section 12, a pinion 13 driven by the motor section 12 to allow the pinion 13 to rotate and a pinion actuator 14 used for pushing out the pinion 13.

The pinion 13 is connected to a rotary shaft of a reduction mechanism (not shown) of the motor section 12 via a one-way clutch (not shown). The pinion 13 is configured to be movable in an axial direction of the rotary shaft. The pinion actuator 14 includes a plunger 15 and a plunger solenoid 16 and is configured to push out the pinion 13 when the engine starts. The plunger 15 is connected to the one-way clutch of the pinion 13 via the lever 17. The plunger 15 is suctioned towards a direction A indicated by the arrow when the plunger solenoid 16 is powered whereby the lever 17 rotates about a shaft 18 so as to allow the pinion 13 to push out together with the one way clutch. Therefore, the pinion 13 meshes with a ring gear 21 that is connected to the crank shaft of the engine 20. At this time, a movable contact 15*a* disposed at the end portion of the plunger 15 closes contacts of a power switch 22 of the motor section 12 so that the power switch 22 is turned on. As a result, power is supplied to the motor section 12 to allow the pinion 13 to rotate whereby the engine 20 starts cranking and therefore starts operation.

The rotational rate of the engine 20 (i.e., rotational rate of the ring gear 21) when the engine-start operation completes is higher than the no-load rotational rate (i.e., rotational rate when no-load is applied) of the starter 11. Hence, after the rotational rate of the pinion 13 of the starter 11 exceeds the no-load rotational rate, the pinion 13 of the starter 11 can be rotatable by the ring gear 21 of the engine 20. However, since the one way clutch of the pinion 13 runs idle, the motor section 12 of the starter 11 is not rotated by the ring gear 21.

Meanwhile, a gear-shape signal rotor 24 is disposed at the crank shaft of the engine 20 to engage therewith and a crank angle sensor 25 is arranged at a position facing to periphery of the signal rotor 24. A pulse signal outputted per predetermined crank angle from the crank angle sensor 25 is inputted to an engine control unit (hereinafter referred to ECU) 26. The ECU 26 is configured to calculate the engine rotational rate based on intervals of the output pulse signal of the crank angle sensor 25. Also, the ECU 26 counts output pulses from the crank angle sensor 25 referenced to a position where the pulse is outputted from a cam angle sensor (not shown) and detects the crank angle from the count value.

Figure 11:
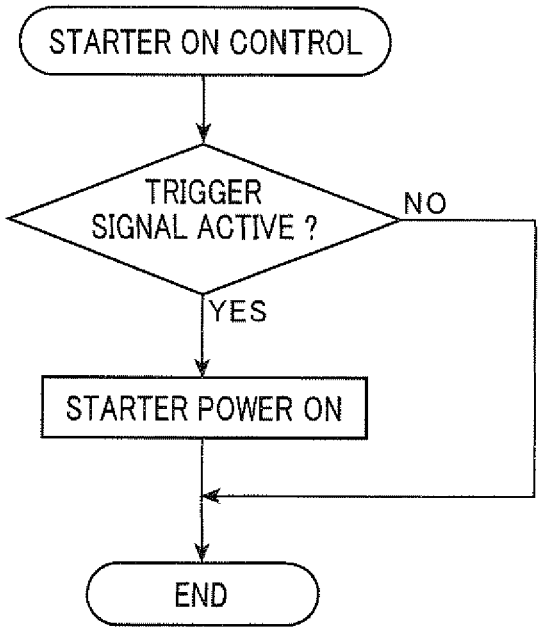
FIG. 11 is a flowchart showing a procedure of the power-on control of the starter.

A power relay circuit 28 which is normally open type is arranged between the power supply terminal of the plunger solenoid 16 and the battery 27. The ECU 28 controls a coil 28*a* of the power relay circuit 28 to be ON and OFF. Note that the ECU 26 corresponds to a controller that includes power on-off control of the starter (the power on-off control function corresponds to first and second control means respectively). As shown FIG. 11, the ECU 26 powers on the starter to start the engine when a trigger signal is active. The trigger signal becomes active in response to a start request which is depends on types of vehicle. Specifically, the ECU 26 is configured such that the ECU 26 acquires an ON/OFF signal (i.e., trigger signal) from a press type start switch 30 and supplies the power to the coil 28*a* of the power relay circuit 28*b* so as to enable the power relay circuit 28*b* to be ON when the ON/OFF signal from the start switch is ON. As a result, the plunger solenoid 16 of the pinion actuator 14 in the starter 11 is powered to allow the pinion 13 to mesh with the ring gear 21 and then, the movable contact 15*a* disposed at the end portion of the plunger 15 closes the contacts of the power switch 22 thereby supplying power to the motor section 12 so that the pinion 13 starts to rotate whereby the engine 20 is cranked and started.

Regarding the start switch, instead of the press-type start switch, the rotary-type ignition key switch can be used. When the rotary type ignition key switch is used, when the driver turns the ignition key to the START position from the ON position (i.e., start request), the coil 28*a* of the power relay circuit 28 is supplied with the power to turn the switch 28*b* of the power relay circuit 28*b* ON.

The ECU 26 executes an engine automatic stop/restart control procedure (not shown) to perform an engine automatically stop/restart control (i.e., idle stop control). In the engine automatically stop/restart control, when the driver operates the vehicle to be slowdown (applying a braking operation during accelerator pedal being off, i.e., throttle valve is fully closed) while the vehicle is running so that a predetermined deceleration state where the vehicle may stop is detected, the ECU 26 determines that an automatic stop request (idle stop request) has been occurred and controls the combustion of the engine 20 (fuel injection and/or ignite operation) to be stopped whereby the engine 20 is automatically stopped (i.e., idle stop). Also, the ECU 26 determines occurring of the automatic stop request when the braking operation is continued while the vehicle is stopped and performs the idle stop by stopping the combustion of the engine 20.

Subsequently, when the driver operates necessary operation to run the vehicle such as releasing of the brake, shifting transmission gear to drive position or pressing down the accelerator pedal, the ECU 26 determines that the restart request has occurred (i.e., start request). Then, the ECU 26 supplies power to the coil 28*a* of the power relay circuit 28 to turn the switch 28*b* of the power relay circuit 28 to be ON. Therefore, the plunger solenoid 16 is powered and the plunger 15 is suctioned by the electromagnetic force whereby the pinion 13 moves towards the ring gear 21 and meshes thereto. At the same time, the movable terminal 15*a* disposed at the end portion of the plunger 15 closes the contacts of the power switch 22 of the motor section 12 to turn the power switch 22 ON. Accordingly, the power is supplied to the motor section 12 and the pinion 13 starts to rotate thereby cranking the engine 20 and the fuel injection starts to restart the engine 20.

Further, it is considered that the restart request occurs at an on-vehicle control system such as a battery charge control system or an air conditioner. The restart request occurs while the engine rotational rate is decreasing (hereinafter referred to engine rotational rate decrease period) or occurs after the engine rotation stops.

Moreover, the ECU 26 monitors whether or not the pinion 13 of the starter 11 is rotatable by the ring gear 21 while the starter is powered (both switches 28*b* and 22 are ON). When the pinion 13 of the starter 11 is rotatable by the ring gear 21, the ECU 21 stops supplying power to the coil 28*a* of the power relay circuit 28 to make the switch 28*b* of the power relay circuit 28 OFF whereby the plunger solenoid 16 of the pinion actuator 14 is powered OFF. Therefore, the plunger 15 returns to the OFF position by a return spring (not shown) of the pinion actuator 14 whereby the pinion 13 is detached from the ring gear 21 and the contacts of the power switch 22 becomes open. As a result, supplying power to the motor section 12 of the starter 11 is stopped.

Figure 2:
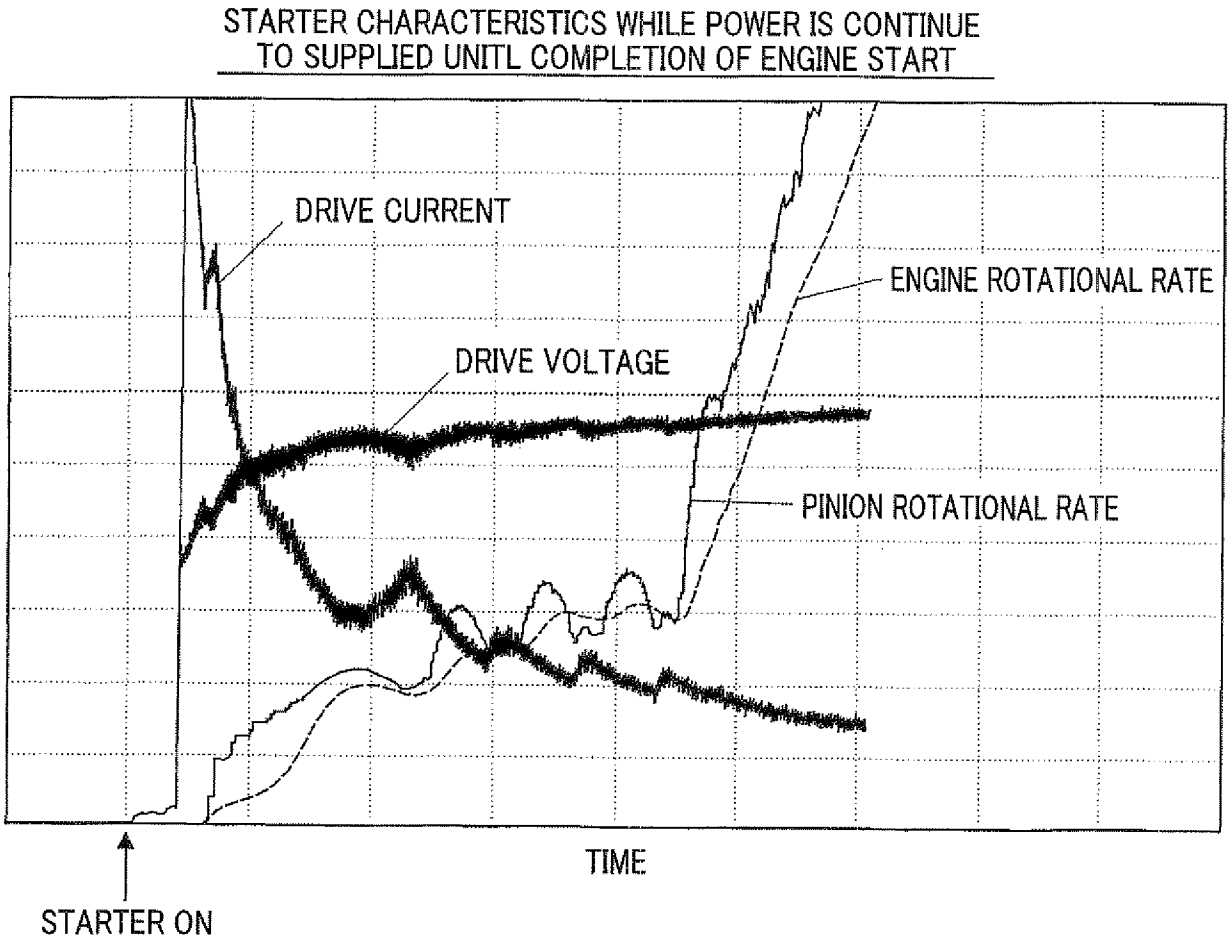
FIG. 2 is a timing diagram that exemplifies a drive current of the starter, a drive voltage of the starter, a pinion rotational rate and a behavior of an engine rotational rate while the engine is starting.

FIG. 2 is a timing diagram that exemplifies a drive current of the starter 11, a drive voltage of the starter 11, a pinion rotational rate and a behavior of an engine rotational rate while the engine is starting. When the rotational rate of the engine and the rotational rate of the pinion of the starter 11 increase while the engine is starting, the load (torque) of the starter 11 decreases. The drive current and power of the starter 11 decreases in response to decreasing of the load of the starter. However, the drive voltage of the starter 11 increases.

According to the first embodiment, since a torque of the pinion 13 applied to the ring gear 21 is detected, it is determined whether or not the pinion 13 of the starter 11 is rotatable by the ring gear 21 (i.e., pinion 13 is driven by the ring gear 21). Therefore, a torque sensor 32 is arranged to detect the torque applied to the ring gear 21 (applied by the pinion 13) and the output signal of the torque sensor 32 is inputted to the ECU 26.

The ECU 26 is configured to monitor the torque detected by the torque sensor 32 while the starter 11 is powered. The ECU 26 determines that the pinion gear 13 of the starter 11 has been driven by the ring gear 21 when the detected torque is equal to or less than a predetermined value and then, the ECU 26 controls the switches 28*b* and 22 to be OFF to stop supplying power to the starter 11.

While the engine is starting, when the rotational rate of the engine increases, an operational state where the pinion 13 of the starter 11 drives the ring gear 21 changes to an inverted state where the ring gear 21 drives the pinion 13 to rotate thereby. As a result, rotation of a motor of the starter 11 becomes idle rotation so that the torque applied to the ring gear by the pinion 13 becomes an idle torque. Accordingly, the above-described predetermined value (predetermined threshold value) is set to be a torque value which is the idle torque or around the idle torque so that the inverted state can be detected correctly.

Alternatively, the ECU 26 monitors a change rate of the torque which is applied to the ring gear 21 by the pinion 13 to detect whether or not the operational state changes to the inverted state. Specifically when the change rate of the torque reaches a predetermined value or more, the ECU 26 determines that the operational state changes to the inverted state where the ring gear 21 drives the pinion 13 to rotate thereby, and then the ECU 26 stops supplying power to the starter 11. When the pinion 13 of the starter 11 is driven by the ring gear 21, the torque applied to the ring gear 21 by the pinion 13 of the starter 11 becomes idle. Hence, by monitoring the change rate of the torque, the ECU 26 can determine whether or not the inverted state occurs.

Figure 3:
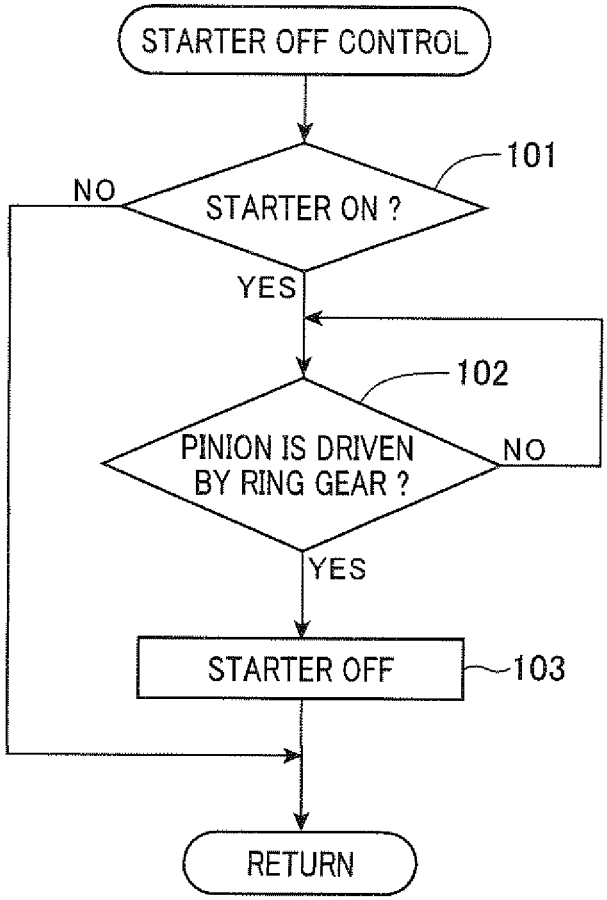
FIG. 3 is a flowchart for explaining a technical feature of a power-off control of the starter.

FIG. 3 is a flowchart for explaining a technical feature of a power-off control of the starter. The power-off control of the starter of the present invention is periodically executed while the ECU 26 is powered on. At step 101, the ECU 26 determines whether or not the starter 11 is powered-on (engine is starting). The procedure is ended if the starter is not powered on.

When the ECU 26 determines that the starter 11 is powered-on at step 101, the ECU 26 proceeds to step 102. At step 102, the ECU 26 determines whether or not the pinion 13 has been driven by the ring gear 21. This procedure is repeated until the pinion 13 is driven by the ring gear 21.

Subsequently, when the pinion 13 come to a state where the pinion 13 is driven by the ring gear 21, the ECU 28 proceeds to step 103 and turns the switches 28*b* and 22 OFF in order to stop supplying power to the starter 11.

Figure 4:
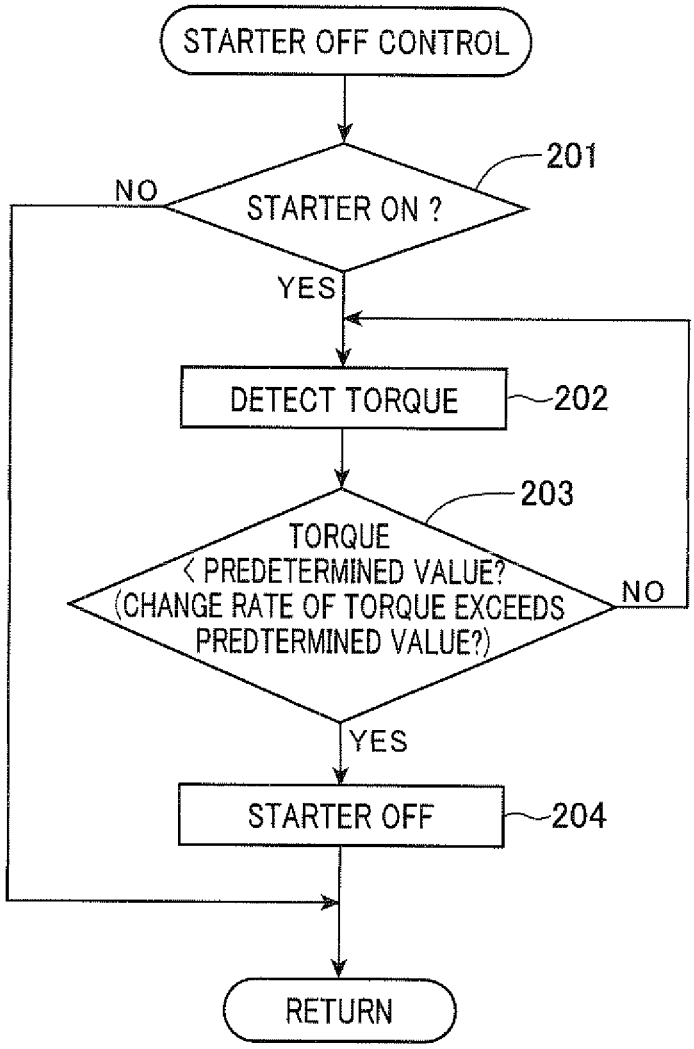
FIG. 4 is a flowchart showing a detail procedure of the power-off control of the starter according to a first embodiment.

FIG. 4 is a flowchart showing a detail procedure of the power-off control of the starter according to the first embodiment. This procedure is periodically executed while the ECU 26 is powered ON. First, the ECU 26 determines whether or not the starter 11 is powered ON (engine is starting). The ECU 26 terminates the procedure if the starter is not operating (powered OFF).

At step 201, when the ECU 26 determines that the starter 11 is powered ON (engine is starting), the ECU 26 proceeds to step 202 and detects the torque of the pinion 13 applied to the ring gear 21 by using the torque sensor 32. Subsequently, at step 203, the ECU 26 determines whether or not the torque detected by the torque sensor 32 is a predetermined value or less (or change rate of the torque reaches the predetermined value or more). When the ECU 26 determines "NO", then returns to step 202. Accordingly, the ECU 26 continue to execute this procedure (steps 202 to 203) until the torque detected by the torque sensor 32 reaches predetermined value or less (or the change rate of the torque reaches the predetermined value or more).

Subsequently, when the torque detected by the torque sensor 32 reaches the predetermined value or less (or the change rate of the torque reaches the predetermined value or more), the ECU 26 determines that the pinion 13 of the starter 11 has been driven by the ring gear 21 and proceeds to step 204. At step 204, the ECU 26 controls the switches 28*b* and 22 to be OFF in order to stop supplying power to the starter 11.

As described, according to the first embodiment, even when the engine rotational rate does not reach the predetermined threshold value while the starter 11 is powered, the starter 11 can be powered off at a time when the inverted state where the pinion 13 of the starter 11 is driven by the ring gear 21 disposed at the engine 20 side (at a time when the starter 11 cannot drive the engine to rotate) is detected. As a result, the operating period (period for powering ON) of the starter 11 can be shortened compared to a starter used in prior art. Also, load of the battery 27 can be reduced and durability of the starter 11 can be enhanced.

Second Embodiment

Figure 5:
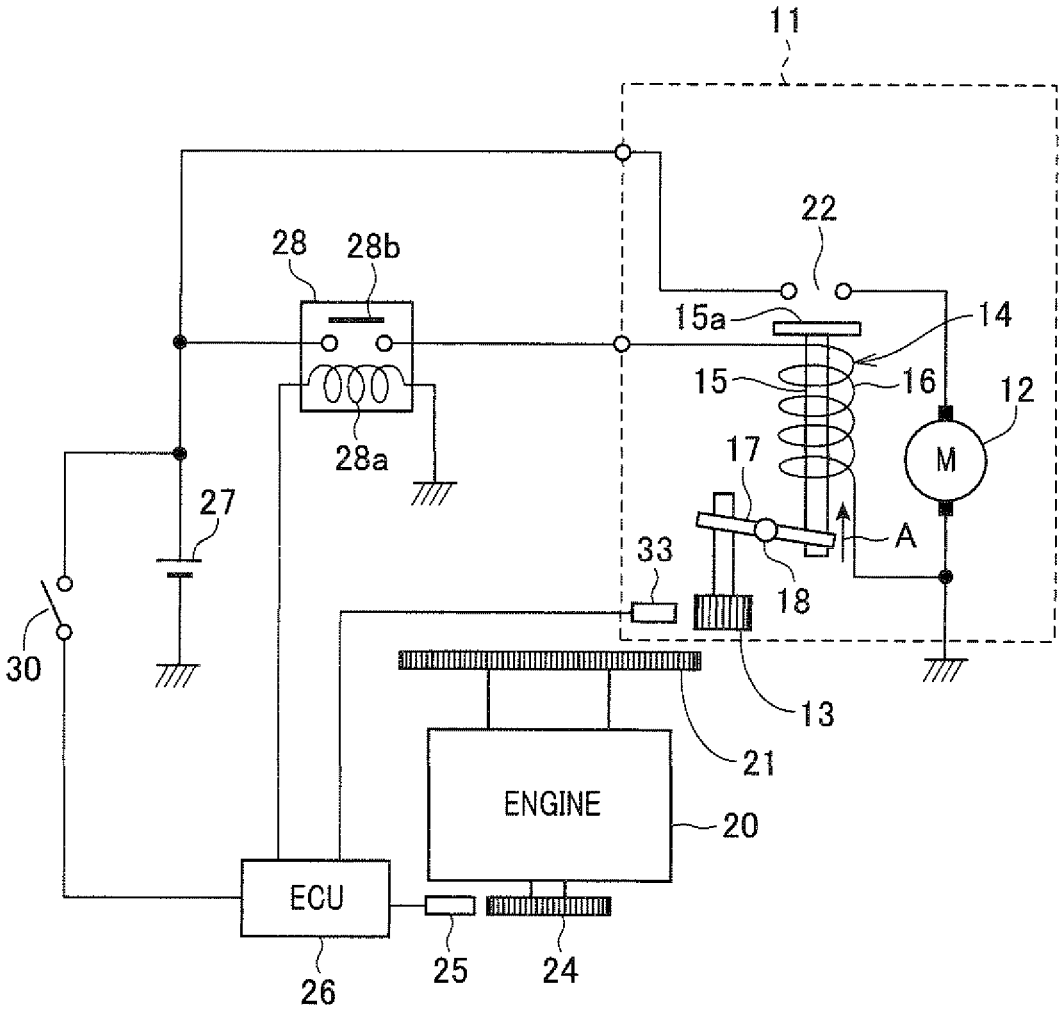
FIG. 5 is a diagram showing an overall configuration of a control system for starting the engine according to a second embodiment.
Figure 6:
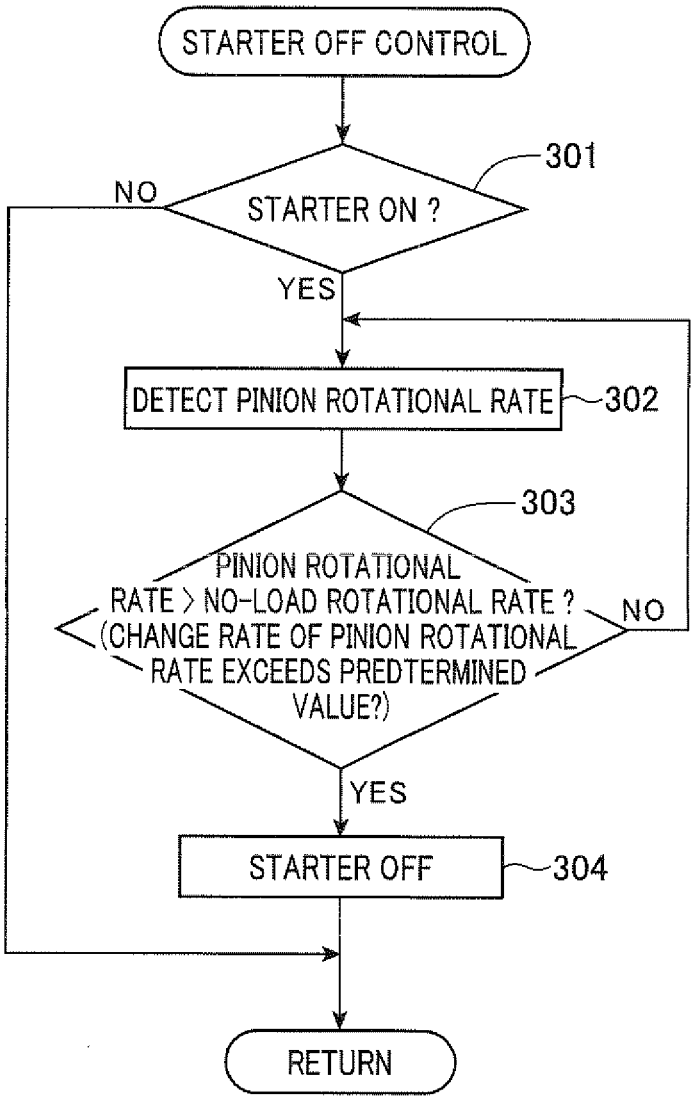
FIG. 6 is a flowchart showing a detail procedure of the power-off control of the starter according to the second embodiment.

With reference to FIGS. 5 and 6, hereinafter will be described a second embodiment of the present invention. According to the above-described first embodiment, to detect the state where the pinion 13 of the starter 11 has been driven by the ring gear 21 of the engine 20 side while the starter 11 is powered, the torque sensor 32 is arranged. However, according to a second embodiment of the present invention as shown in FIGS. 5 and 6, a pinion rotational rate sensor 33 to detect a rotational rate of the pinion of the starter 11 is provided (torque sensor 32 in the first embodiment is not provided).

According to the second embodiment, while the starter 11 is powered ON, the ECU 26 determines whether or not the pinion rotational rate detected by the pinion rotational rate sensor reaches the no-load rotational rate or more. When the pinion rotational rate reaches the no-load rotational rate or more, the ECU 26 determines that the pinion 13 has been driven by the ring gear 21. The ECU 26 is configured to stop supplying power to the starter 11 since the pinion rotational rate is larger than or equal to the no-load rotational rate when the pinion 13 of the starter 11 is driven by the ring gear 21. Note that the no-load rotational rate is referred to a rotational rate when no load is applied.

Alternatively, the ECU 26 may be configured to monitor whether or not the change rate of the pinion rotational rate reaches a predetermined value or more, and determines that the pinion 13 of the starter 11 has been driven by the ring gear 21 when the change rate of the pinion rotational rate reaches a predetermined value or more. Then, the ECU 26 stops supplying power to the starter 11. In a region where the pinion rotational rate of the starter 11 exceeds the no-load rotational rate, the engine rotational rate rapidly increases due to a combustion pressure whereby the pinion rotational rate rapidly increases as well. Therefore, by detecting the change rate of the pinion rotational rate, the ECU 26 can determine that the pinion 13 of the starter 11 is driven by the ring gear 21.

According to the second embodiment, as shown in FIG. 6, the ECU 26 repeatedly executes the power-off control routine of the starter at a predetermined period while the ECU 26 is powered ON. When the power-off control routine is activated, the ECU 26 determines whether or not the starter 11 is powered ON (engine is starting) at step 301. This routine is terminated when the starter 11 is not powered ON.

The ECU 26 executes step 302 when it is determined that the starter 11 is powered ON (engine is starting) at step 301. At step 302, the pinion rotational rate of the starter 11 is detected by the pinion rotational rate sensor 33. At step 303, the ECU 26 determines whether or not the pinion rotational rate detected by the pinion rotational rate sensor 33 is no-load rotational rate or more (or whether or not the change rate of the pinion rotational rate reaches a predetermined value or more). When the determination result is NO, then the ECU 26 returns to step 302. Accordingly, this procedure is repeated until the pinion rotational rate reaches the no-load rotational rate or more (or the change rate of the pinion rotational rate reaches a predetermined value or more).

Subsequently, when the pinion rotational rate reaches the no-load rotational rate or more (or the change rate of the pinion rotational rate reaches a predetermined value or more), the ECU 26 determines that the pinion 13 of the starter 11 has been driven by the ring gear 21 and proceeds to the step 304. Then, the ECU 26 turns the switches 28*b* and 22 OFF to stop supplying the power to the starter 11.

According to above-described second embodiment, the operating period (period for powering ON) of the starter 11 can be reduced as well as the first embodiment. Further, reducing the load of the battery 27 and enhancing the durability of the starter 11 can be achieved.

Third Embodiment

Figure 7:
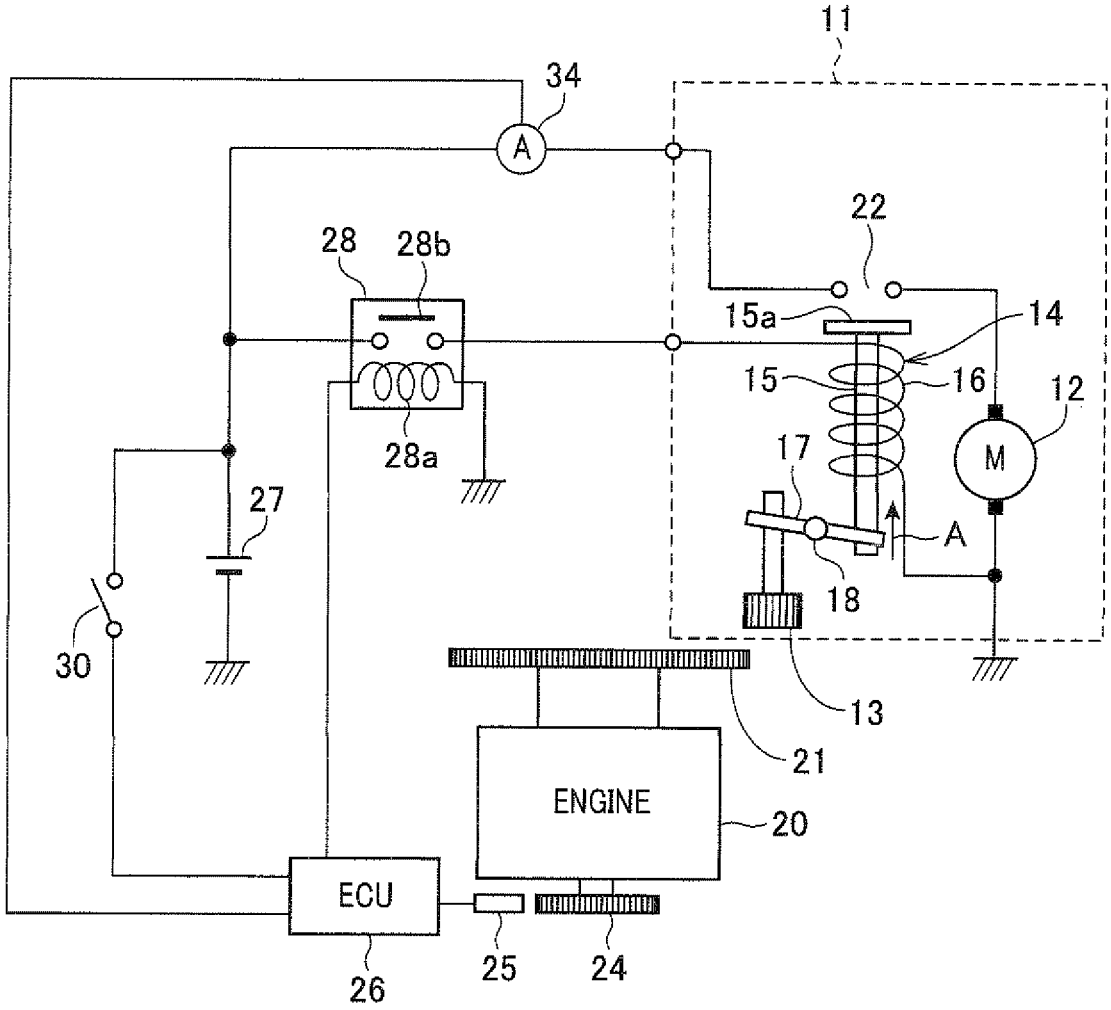
FIG. 7 is a diagram showing an overall configuration of a control system for starting the engine according to a third embodiment.
Figure 8:
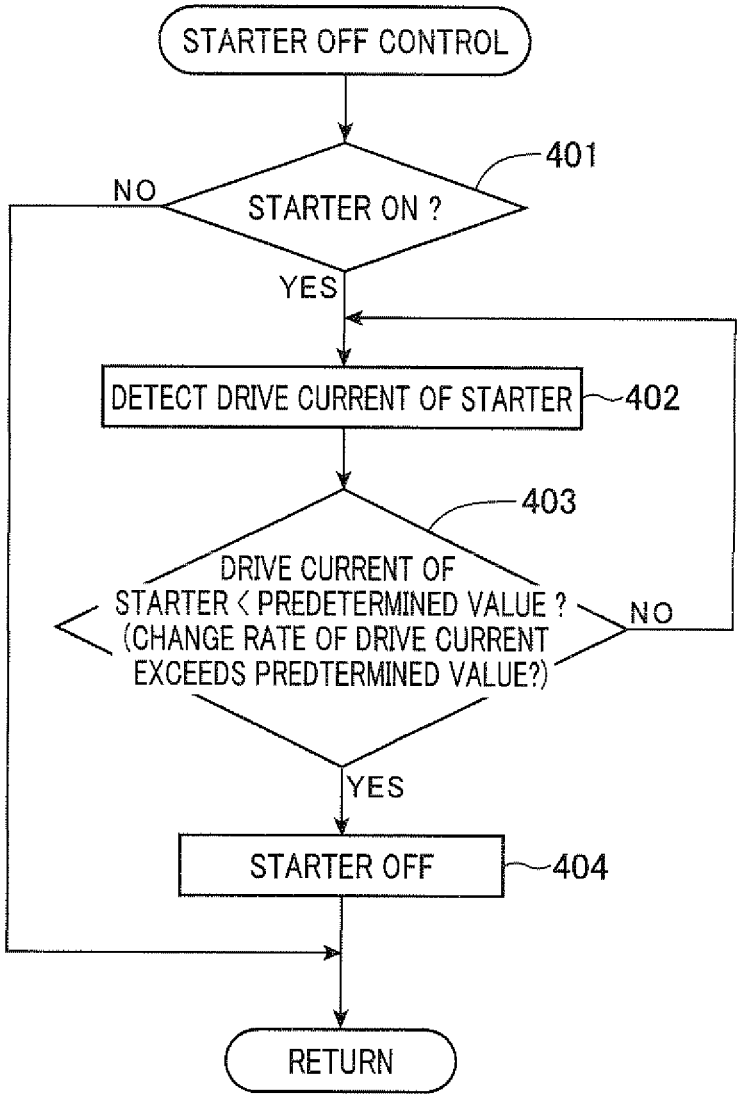
FIG. 8 is a flowchart showing a detail procedure of the power-off control of the starter according to the third embodiment.

With reference to FIGS. 7 and 8, hereinafter will be described a third embodiment of the present invention. As shown in FIGS. 7 and 8, a current sensor 34 is arranged to detect drive current of the starter 11 (drive current of the motor section 12). In this configuration, it is determined that the pinion 13 of the starter 11 has been driven by the ring gear 21 when the drive current of the starter 11 reaches a predetermined value or less whereby the ECU 26 stops supplying power to the starter 11.

As shown in FIG. 2, while the engine is starting, load (torque) of the starter 11 decreases when the rotational rate of the engine rotation rate increases so that the drive current of the starter 11 decreases. Accordingly, it is determined that the pinion 13 has been driven by the ring gear 21 when the drive current of the starter 11 reaches the predetermined value or less.

Alternatively, it is determined that the pinion 13 has been driven by the ring gear 21 when the change rate of the drive current of the starter 11 reaches a predetermined value or more and then, the ECU 26 stops supplying power to the starter 11. When the pinion rotational rate of the starter 11 exceeds the no-load rotational rate, the engine rotational rate rapidly increases due to the combustion pressure whereby the load (torque) of the starter 11 rapidly changes. Therefore, monitoring the change rate of the drive current of the starter 11, it is determined that the pinion 13 has been driven by the ring gear 21 when the change rate of the drive current rapidly increases.

According to the third embodiment, the ECU 26 periodically executes the power-off control of the starter as shown in FIG. 8. When the power-off control of the starter is activated, the ECU 26 checks whether or not the starter 11 is powered on (engine is starting). The ECU 26 terminates the procedure when the starter 11 is not powered ON.

At step 401, the ECU 26 determines whether or not the starter 11 is powered ON (engine is starting). When the starter 11 is powered ON, the ECU 26 proceeds to step 402 where the drive current of the starter 11 is detected by the current sensor 34. Subsequently, at step 403, it is determined whether or not the drive current of the starter 11 detected by the current sensor 34 is predetermined value or less (or the change rate of the drive current of the starter 11 reaches a predetermined value or more). When a judgment at step 403 is NO, then the ECU 26 returns to step 402. Accordingly, this procedure is repeated until the drive current of the starter 11 reaches the predetermined value or less (or the change rate of the drive current of the starter reaches the predetermined value or more).

Subsequently, when the drive current of the starter 11 decreases to reach the predetermined value or less (or the change rate of the drive current of the starter 11 reaches a predetermined value or more), it is determined that the pinion 13 has been driven by the ring gear 21 and proceeds to step 404. At step 404, the ECU 26 turns OFF switches 28*b* and 22 so as to stop supplying power to the starter 11. As described, in the third embodiment, the operating period of the starter 11 can be shortened as similar to the one of the first embodiment. Therefore, the load of the battery 27 can be reduced and the durability of the starter 11 is enhanced as well.

Alternatively, the ECU 26 monitors whether or not a drive current value of the starter 11 detected by the current sensor 34 while the starter 11 is powered ON (engine is starting) reaches a no-load current value. The ECU 26 determines that the pinion 13 has been driven by the ring gear 21 when the drive current reaches the no-load current value and controls the switches 28*b* and 22 to be OFF to stop supplying power to the starter 11. Since the drive current of the starter 11 decreases to reach the no-load current value when the rotational rate of the pinion 13 reaches the no-load rotational rate, the ECU 26 can determine that the pinion 13 has been driven by the ring gear 21 by monitoring the drive current of the starter 11.

Further, a drive power of the starter 11 can be detected to determine whether or not the drive power of the starter 11 decreases to a predetermined value or less (or a change rate of the drive power of the starter 11 reaches a predetermined value or more). When the drive power of the starter 11 is predetermined value or less, it is determined that the pinion 13 has been driven by the ring gear 21 so that the switches 28*b* and 22 are controlled to be OFF to stop supplying power to the starter 11.

Fourth Embodiment

Figure 9:
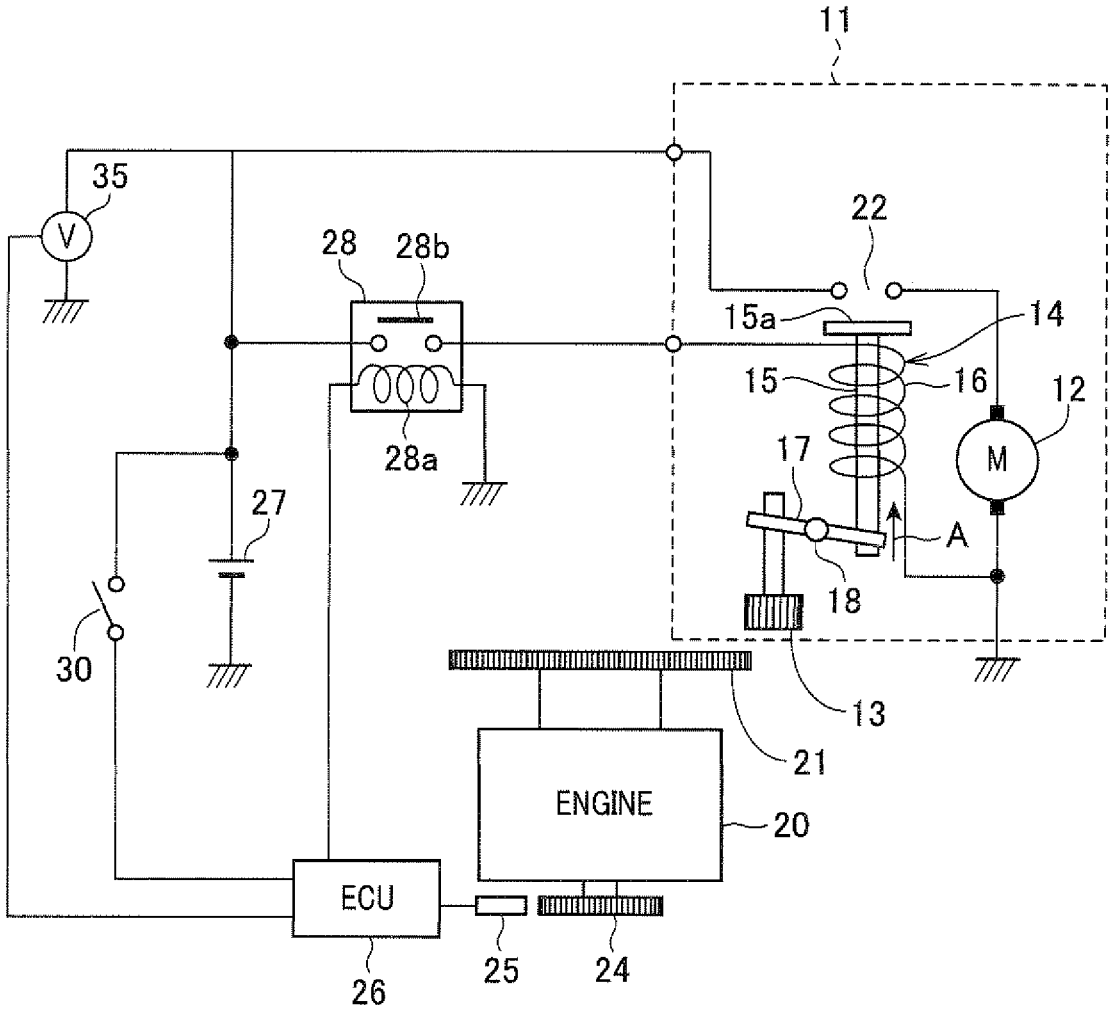
FIG. 9 is a diagram showing an overall configuration of a control system for starting the engine according to a fourth embodiment.
Figure 10:
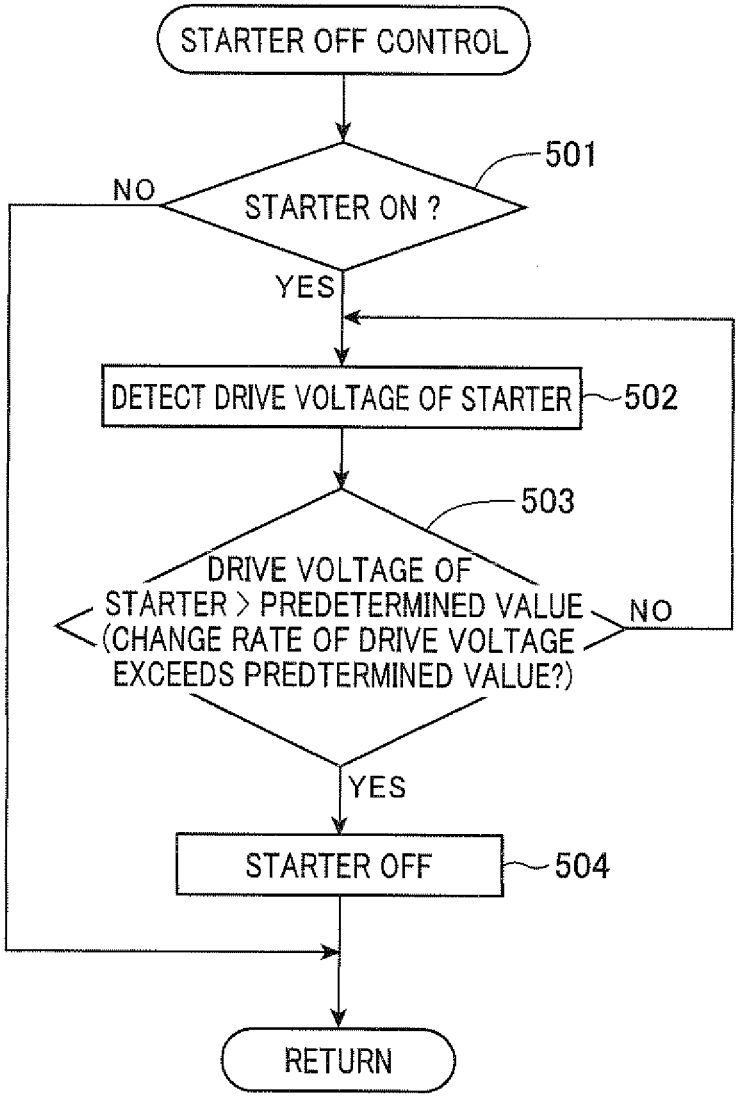
FIG. 10 is a flowchart showing a detail procedure of the power-off control of the starter according to the fourth embodiment.

With reference to FIGS. 9 and 10, a fourth embodiment of the present invention is now described as follows. According to the fourth embodiment, a voltage sensor 35 is arranged to detect a drive voltage of the starter 11 (voltage applied to the motor section 12). The drive voltage is monitored to detect whether or not the drive voltage reaches the predetermined value or more. The ECU 26 determines that the pinion 13 has been driven by the ring gear 21 when the drive voltage reaches the predetermined value or more and then, the ECU 26 stops supplying power to the starter 11. While the engine is starting, the torque (load) of the starter 11 decreases in response to an increase of the engine rotational rate whereby the drive voltage of the starter 11 increases. Accordingly, it is determined whether or not the pinion 13 has been driven by the ring gear 21 by detecting whether or not the drive voltage of the starter 11 reaches the predetermined value or more.

Alternatively, a change rate of the drive voltage of the starter 11 can be used to determine that the pinion 13 has been driven by the ring gear 21. Specifically, the ECU 26 detects whether or not the change rate of the drive voltage reaches predetermined value or more and determine that the pinion 13 has been driven by the ring gear 21 when the change rate of the drive voltage reaches the predetermined value or more. Then, the ECU 26 stops supplying power to the starter 11. When the pinion rotational rate of the starter 11 exceeds the no-load rotational rate, the engine rotational rate rapidly increases due to a combustion pressure so that the load (torque) of the starter 11 rapidly changes. Therefore, by detecting whether or not the change rate of the drive voltage of the starter 11 changes rapidly, the ECU can detect that the pinion 13 has been driven by the ring gear 21.

According to the fourth embodiment, as shown in FIG. 10, the ECU 26 repeatedly executes a power-off control of the starter in a predetermined period. Once the procedure is activated, the ECU 26 determines whether or not the starter 11 is powered ON (engine is starting) at step 501. The ECU 26 terminates the procedure when the starter 11 is not powered ON.

When the ECU 26 determines the starter 11 is powered ON (engine is starting) at step 501, then proceeds to step 502 where the voltage sensor 35 detects the drive voltage of the starter 11. Subsequently, at step 503, it is determined whether or not the drive voltage of the starter 11 is predetermined value or more (or the change rate of the drive voltage of the starter 11 reaches the predetermined value or more). When the judgment at step 503 is NO, then returns to step 502. Accordingly, this procedure is repeated until the drive voltage of the starter 11 reaches the predetermined value or more (or the change rate of the drive voltage of the starter reaches the predetermined value or more).

Subsequently, when the drive voltage of the starter 11 reaches the predetermined value or more (or the change rate of the drive voltage of the starter 11 reaches the predetermined value or more), the ECU 26 determines that the pinion 13 has been driven by the ring gear 21 and proceeds to step 504 where the switches 28*b* and 22 are turned OFF whereby the starter 11 is powered OFF. Similarly to the first embodiment, according to the above-described fourth embodiment, the operating period (period for powering ON) of the starter 11 can be shortened compared to a starter used in prior art. Also, load of the battery 27 can be reduced and durability of the starter 11 can be enhanced.

The present invention can be applied to a vehicle without having an automatic stop/restart system (idle stop system). However, the present invention is preferably applied to a vehicle having an automatic stop/restart system. Since the automatic stop/restart system requires frequent engine restart operation, the present invention has significant advantages in view of reducing the load of the battery and durability of the starter 11 which should be enhanced in the automatic stop/restart system.

In addition, the configuration of the starter 11 is not limited to those as shown in FIG. 1 or the like, however, various modification can be made. For instance, the motor section 12 and pinion actuator 14 can be configured to be controlled separately (respective switches 22 and 28*b* can be configured to be controlled separately).

Further, the configuration of the present invention can be adapted to a permanently engaged starter in which the pinion and the ring gear of the engine side are always engaged even after completion of the engine start. Moreover, the present invention is not limited to the above-described embodiments. However, various modifications can be made within a scope of the invention. For instance, any combination of the above-described embodiments can be adapted to the present invention.

What is claimed is:

1. A control apparatus for controlling a starter used to start an engine mounted on a vehicle, the starter generating a torque for starting the engine and having a first gear outputting the generated torque, the engine having a second gear to receive the torque, the first gear mechanically engaging with the second gear to start the engine, the control apparatus comprising:

a trigger circuit adapted to output a trigger signal in response to a start request;

a detection circuit adapted to detect an overall state of the starter which comprises an electrical state and a mechanical state of the starter while the starter is powered on; and a controller including first means configured to power on the starter in response to the trigger signal outputted by the trigger circuit, and second means configured to power off the starter when the controller detects that a predetermined condition of the starter is satisfied based on the overall state of the starter, wherein the predetermined condition is that the first gear is rotated the second gear while the starter is powered on, and the detection circuit is configured to detect a torque of the first gear as the mechanical state of the starter, the torque of the first gear being transmitted to the second gear, and the controller detects the predetermined condition when the torque has a predetermined value or less.

2. A control apparatus for controlling a starter used to start an enginge mounted on a vehicle, the starter generating a torque for starting the engine and having a first gear outputting the generated torque, the engine having a second gear to receive the torque, the first gear mechanically engaging with the second gear to start the engine, the control apparatus comprising:

a trigger circuit adapted to output a trigger signal in response to a start request;

a detection circuit adapted to detect an overall state of the starter which comprises an electrical state and a mechanical state of the starter while the starter is powered on; and a controller including first means configured to power on the starter in response to the trigger signal outputted by the trigger circuit, and second means configured to power off the starter when the controller detects that a predetermined condition of the starter is satisfied based on the overall state of the starter, wherein the predetermine condition is that the first gear is rotated by the second gear while the starter is powered on, and the detection circuit is configured to detect a torque at the first gear as the mechanical state of the starter, the torque at the first gear being transmitted to the second gear, and the controller detects the predetermined condition when a change rate of the torque is a predetermined value or more.

3. A control apparatus for controlling a starter used to start an engine mounted on a vehicle, the starter generating a torque for starting the engine and having a first gear outputting the generated torque, the engine having a second gear to receive the torque, the first gear mechanically engaging with the second gear to start the engine, the control apparatus comprising:

a trigger circuit adapted to output a trigger signal in response to a start request;

a detection circuit adapted to detect an overall state of the starter which comprises an electrical state and a mechanical state of the starter while the starter is powered on; and a controller including first means configured to power on the starter in response to the trigger signal outputted by the trigger circuit, and second means configured to power off the starter when the controller detects that a predetermined condition of the starter is satisfied based on the overall state of the starter, wherein the predetermined condition is that the first gear is rotated by the second gear while the starter is powered on, and the detection circuit is configured to detect a rotational rate of the first gear as the mechanical state of the starter, and the controller detects the predetermined condition when the rotational rate of the first gear is a no-load rotational rate or more.

4. A control apparatus for controlling a starter used to start an engine mounted on a vehicle, the starter generating a torque for starting the engine and having a first gear outputting the generated torque, the engine having a second gear to receive the torque, the first gear mechanically engaging with the second gear to start the engine, the control apparatus comprising:

a trigger circuit adapted to output a trigger signal in response to a start request;

a detection circuit adapted to detect an overall state of the starter which comprises an electrical state and a mechanical state of the starter while the starter is powered on; and a controller including first means configured to power on the starter in response to the trigger signal outputted by the trigger circuit, and second means configured to power off the starter when the controller detects that a predetermined condition of the starter is satisfied based on the overall state of the starter, wherein the predetermined condition is that the first gear is rotated by the second gear while the starter is powered on, and the detection circuit is configured to detect a change rate of the rotational rate of the first gear as the mechanical state of the starter, and the controller detects the predetermined condition when the change rate of the rotational rate is a predetermined value or more.

5. A control apparatus for controlling a starter used to start an engine mounted on vehicle, the starter generating a torque for starting the engine and having a first gear outputting the generated torque, the engine having a second gear to receive the torque, the first gear mechanically engaging with the second gear to start the engine, the control apparatus comprising:

a trigger circuit adapted to output a trigger signal in response to a start request;

a detection circuit adapted to detect an overall state of the starter which comprises an electrical state and a mechanical state of the starter while the starter is powered on; and a controller including first means configured to power on the starter in response to the trigger signal outputted by the trigger circuit, and second means configured to power off the starter when the controller detects that a predetermined condition of the starter is satisfied based on the overall state of the starter, wherein the predetermined condition is that the first gear is rotated by the second gear while the starter is powered on, and the detection circuit is configured to detect a drive current or a drive power as an electrical state of the starter, the controller detects the predetermined condition when the drive current or the drive power is a predetermined value or less.

6. A control apparatus for controlling a starter used to start an engine mounted on a vehicle, the starter generating a torque for starting the engine and having a first gear outputting the generated torque, the engine having a second gear to receive the torque, the first gear mechanically engaging with the second gear to start the engine, the control apparatus comprising:

a trigger circuit adapted to output a trigger signal in response to a start request;

a detection circuit adapted to detect an overall state of the starter which comprises an electrical state and a mechanical state of the starter while the starter is powered on; and a controller including first means configured to power on the starter in response to the trigger signal outputted by the trigger circuit, and second means configured to power off the starter when the controller detects that a predetermined condition of the starter is satisfied based on the overall state of the starter, wherein the predetermined condition is that the first gear is rotated by the second gear while the starter is powered on, and the detection circuit is configured to detect a drive voltage for driving the starter as an electrical state of the starter, the controller detects the predetermined condition when the drive voltage is a predetermined value or more.

7. A control apparatus a for controlling a starter used to start an engine mounted on a vehicle, the starter generating a torque for starting the engine and having a first gear outputting the generated torque, the engine having a second gear to receive the torque, the first gear mechanically engaging with the second gear to start the engine, the control apparatus comprising:

a trigger circuit adapted to output a trigger signal to a start request;

a detection circuit adapted to detect an overall state of the starter which comprises an electrical state and a mechanical state of the starter while the starter is powered on; and a controller including first means configured to power on the starter in response to the trigger signal outputted by trigger circuit, and second means configured to power off the starter when the controller detects that a predetermined condition of the starter is satisfied based on the overall state of the starter, wherein the predetermined condition is that the first gear is rotated by the second gear while the starter is powered on, and the detection circuit is configured to detect any one of a drive current or a drive voltage or a drive power as an electrical state of the starter, the controller detects the predetermined condition when a change rate of any one of a drive current or a drive voltage or a drive power is a predetermined value or more.

8. A control apparatus for controlling a starter used to start an engine mounted on a vehicle, the starter generating a torque for starting the engine and having a first gear outputting the generated torque, the engine having a second gear to receive the torque, the first gear mechanically engaging with the second gear to start the engine, the control apparatus comprising:

a trigger circuit adapted to output a trigger signal in response to a start request;

a detection circuit adapted to detect an overall state of the starter which comprises an electrical state and a mechanical state of the starter while the starter is powered on; and a controller including first means configured to power on the starter in response to the trigger signal outputted by the trigger circuit, and second means configured to power off the starter when the controller detects that a predetermined condition of the starter is satisfied based on the overall state of the starter, wherein the predetermined condition is that the first gear is rotated by the second gear while the starter is powered on, and the detection circuit is configured to detect a drive current as an electrical state of the starter, the controller detects the predetermined condition when the drive current is a no-load current value.

* * * * *

UNITED STATES PATENT AND TRADEMARK OFFICE

CERTIFICATE OF CORRECTION

PATENT NO. : 8,843,299 B2
APPLICATION NO. : 13/027615
DATED : September 23, 2014
INVENTOR(S) : Kawazu et al.

It is certified that error appears in the above-identified patent and that said Letters Patent is hereby corrected as shown below:

In the Claims

At col. 12, line 25, please amend the paragraph as follows:

the predetermined condition is that the first gear is rotated <u>by</u> the second gear while the starter is powered on, and Signed and Sealed this
Twenty-fourth Day of February, 2015

Michelle K. Lee

Michelle K. Lee
*Deputy Director of the United States Patent and Trademark Office*